US010400506B2

(12) United States Patent
Jude

(10) Patent No.: US 10,400,506 B2
(45) Date of Patent: Sep. 3, 2019

(54) DOORS INCLUDING CUSTOMIZABLE AND REMOVABLE STORAGE

(71) Applicant: Kustom Doors LLC, Beaver, WV (US)

(72) Inventor: Terry Mike Jude, Beaver, WV (US)

( * ) Notice: Subject to any disclaimer, the term of this patent is extended or adjusted under 35 U.S.C. 154(b) by 20 days.

(21) Appl. No.: 15/827,454

(22) Filed: Nov. 30, 2017

(65) Prior Publication Data

US 2018/0223593 A1 Aug. 9, 2018

Related U.S. Application Data

(60) Provisional application No. 62/454,319, filed on Feb. 3, 2017.

(51) Int. Cl.

| | |
|---|---|
| ***A47B 67/02*** | (2006.01) |
| ***E06B 7/34*** | (2006.01) |
| ***E05G 1/00*** | (2006.01) |
| ***E06B 3/72*** | (2006.01) |
| *A47B 61/00* | (2006.01) |
| *E05B 51/00* | (2006.01) |
| *E06B 3/70* | (2006.01) |

(52) U.S. Cl.

CPC ..... *E06B 7/34* (2013.01); *E05G 1/005* (2013.01); *E06B 3/725* (2013.01); *A47B 61/003* (2013.01); *E05B 51/00* (2013.01); *E06B 3/7001* (2013.01); *E06B 2003/7046* (2013.01)

(58) Field of Classification Search

CPC ..... E06B 7/34
USPC ..... 312/242, 246, 248, 321.5
See application file for complete search history.

(56) References Cited

U.S. PATENT DOCUMENTS

| | | | | |
|---|---|---|---|---|
| 1,980,730 | A | 11/1934 | Matchette | |
| 2,200,934 | A | 5/1940 | Platt et al. | |
| 3,822,925 | A | 7/1974 | Osroff | |
| 3,997,220 | A | 12/1976 | Mayer | |
| 4,076,350 | A * | 2/1978 | Crist | E04H 1/1238 312/242 |
| 5,163,745 | A | 11/1992 | Zagata | |
| 8,713,857 | B2 | 5/2014 | Logue | |
| 8,864,636 | B1 * | 10/2014 | Danowski | A63B 21/0087 482/112 |
| 2006/0112741 | A1 * | 6/2006 | Engel | F41A 17/066 70/63 |
| 2010/0132895 | A1 * | 6/2010 | Logue | A47B 46/005 160/127 |
| 2010/0293861 | A1 * | 11/2010 | Ting | E05B 47/026 49/394 |
| 2012/0067090 | A1 * | 3/2012 | Varney | E05B 47/004 70/81 |
| 2012/0146470 | A1 * | 6/2012 | Katz | E05D 5/023 312/225 |

(Continued)

*Primary Examiner* — Matthew W Ing
(74) *Attorney, Agent, or Firm* — Dinsmore & Shohl LLP; Monika L'Orsa Jaensson, Esq.

(57) ABSTRACT

A modular insert useful for storing one or more objects, designed and configured to inset within a door having one or more cavities. The modular insert includes a frame having a plurality of walls and a top panel movably affixed to the frame. Some of the walls have apertures to receive wing nuts, screws, bolts, quick release and push-pull pins to secure the modular insert to an interior support structure of the door. Also provided is a door suitable for receiving one or more modular inserts. The door has a plurality of stiles and rails, wherein the stiles and rails form one or more cavities.

18 Claims, 10 Drawing Sheets

(56) References Cited

U.S. PATENT DOCUMENTS

| | | | | |
|---|---|---|---|---|
| 2012/0223626 | A1 | 9/2012 | Thomas | |
| 2012/0280605 | A1 | 11/2012 | Nettles et al. | |
| 2013/0192318 | A1* | 8/2013 | Yanar | E05B 47/0012 70/279.1 |

* cited by examiner

DOORS INCLUDING CUSTOMIZABLE AND REMOVABLE STORAGE

BACKGROUND

The disclosed technology provides a modular insert useful for storing one or more objects, designed and configured to inset within a door having one or more cavities. The disclosed technology further regards a door suitable for mounting the modular inserts of the disclosed technology.

Keeping secrets has been a fascination of humankind since the beginning of time. The desire to hide objects securely has led to numerous creative methods of storage. Egyptians for example, created hidden compartments through the structure of pyramids. In modern time, locked safes are used to protect valuable contents from theft, potential damage, or other threats. Household safes are sometimes integrated into interior and exterior walls, often concealed.

Furthermore, the use of in-wall installations of bookshelves and other storage areas allows users to maximize the empty space between walls, and storage rooms are not uncommon. In households with limited space, people often support objects in hanging arrangement on the back of a cabinet, closet or other door, which maintains the look and integrity of the door.

While many storage methods have been developed to maximize the space behind doors, the space available inside the door is sometimes overlooked. Therefore, there is a need for concealed storage utilizing the space within doors, while maintaining the beauty of the door panels.

The disclosed technology provides for a flexible design wherein a plurality of removable and interchangeable modular inserts, customizable with or without support structures for supporting and securing items therein, are provided for inset into a door. The disclosed technology further provides for a door suitable for receiving and supporting these modular inserts.

GENERAL DESCRIPTION

The disclosed technology provides a modular insert useful for storing one or more objects. Generally, the modular insert includes a frame having a plurality of walls forming a plurality of sides of the frame. The frame further includes a top panel movably affixed to the frame.

The modular insert is designed and configured to inset within a door having one or more cavities, the cavities being defined by a plurality of stiles and rails. In some embodiments, at least two of the modular insert walls have apertures to receive affixation means (e.g., wing nuts, screws, bolts, quick release or push-pull pins) so that the modular insert may be removably secured within the door cavity. In some embodiments the insert has a depth equal to a depth of the stiles and rails of the door defining the cavity; in other embodiments the insert has a greater or lesser depth than the door depth.

In some embodiments, as hereinafter described, the modular insert has a base panel, and the walls of the frame are secured about a perimeter of the interior surface of the base panel; the exterior surface of the base panel may form the exterior of one side of the door, at the cavity, and may be made from or include a layer of material that is the same material as the door, for example the same timber species as a door, or may be made from a different material (or timber species).

The top panel of the modular insert of the disclosed technology may be hingedly affixed to a first side of the frame by, for example, one or more hinges comprising a pair of plates, wherein one of the plates may be secured to a first interior side of the frame, and the other plate is affixed to an interior side of the top panel by means of a block. In some embodiments, the frame comprises a recess along the length of the first side to accommodate the hinge of the modular insert, so that the top panel may be easily opened and closed, and when closed the exterior surface of the top panel is flush with the corresponding door surfaces. In some embodiments, the hinging mechanism is spring loaded to encourage the top panel into its closed position relative to the frame, until opened by a user.

The top panel of the modular insert may have two distinct panels, with the first panel hingedly secured on one side to a first frame wall, and the second panel hingedly secured on one side to a second frame wall, opposing the first frame wall. The top panel (and the base panel, if any) may be sized about ¼" to 1" in length and width greater than the corresponding dimensions of the frame. In these and other embodiments, each of the frame walls may further include a frame segment, extending from a front face of each said wall into the vacuous area formed by the frame walls, and the top panel(s) is(are) hingedly affixed to one of the frame segments.

In some embodiments, the top panel may include a magnet on an interior surface thereof, the magnet having a magnetic field to attract and removably secure a magnet knob when positioned on an exterior surface of the top panel.

Other securing means may be integrated into the modular insert of the disclosed technology to secure the contents within the insert. For example, an actuator electrically engaged with a power supply may lock the top panel to the frame, until the actuator receives a signal to release the lock. The actuator may be controlled by, for example, a remote control, or may be controlled by known means for recognizing an owner, such as gesture recognition, biometric recognition and fingerprint recognition.

Various support structures may be affixed to the frame of the modular insert (or to the back panel, if any), to support one or more of the objects in the modular insert. Support structures suitable for use in the disclosed technology include shelves, hooks, adornment holders, individual storage compartment, rods, tie racks, and combinations thereof.

The modular insert and its support structures may be manufactured from any of a plurality of materials, including plastic, wood, metal or polyesters.

The disclosed technology further regards a door suitable for mounting a modular insert as hereinabove and hereinafter described. The door has a plurality of stiles and rails to form one or more cavities. In this arrangement, the modular inserts are sized and configured to be received in one of the cavities of the door. In some embodiments of the door, the modular inserts are intended to provide both front and back panels to the door, at the cavities; in other embodiments of the door, the door has a fixed panel on one side of the door or at each cavity, and the modular inserts provide the second panel on the opposing side of the door.

The cavities of the door may have an internal mounting structure affixed to the stiles and rails forming the cavity, where the mounting structure has a reduced depth from the depth of the stiles and rails. This reduced depth may be equal to the thickness of the top panel, or when a base panel is present, the combined thickness of the top and base panels (wherein the mounting structure is centrally positioned within the depth of the cavity).

DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
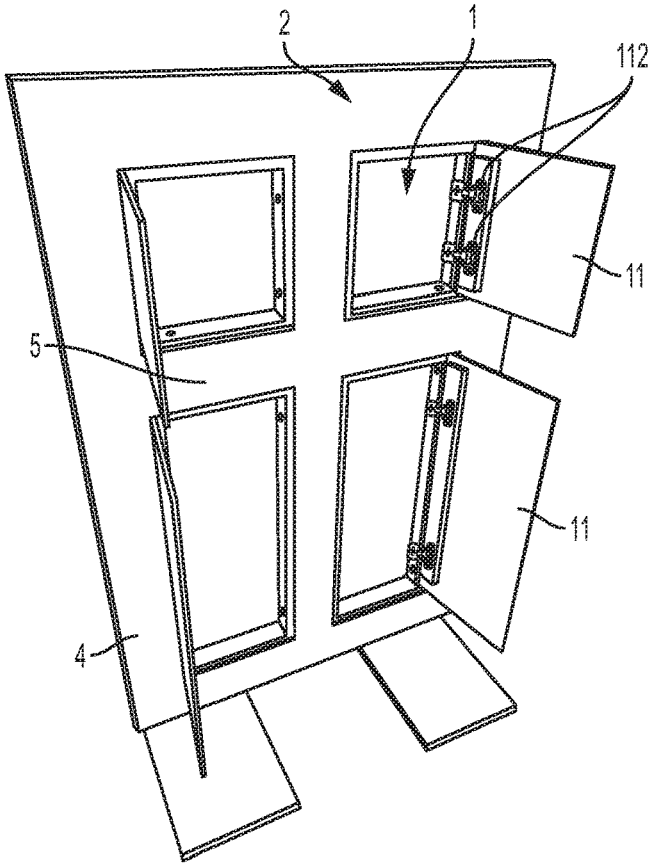
FIG. 1 is front view of an embodiment of the door of the disclosed technology, with modular inserts installed and front panels in the open position.

As shown in FIGS. 1-15, embodiments of the disclosed technology include a modular insert 1 designed and configured to inset within a door 2 having one or more cavities 3 defined by a plurality of stiles 4 and rails 5, wherein the modular insert is sized and configured to be received and removably secured within the cavity. In some embodiments, the insert may have a depth equal to the depth of the stiles and rails so that the exterior panels 11, 12 thereof sit flush with the stiles and rails of the door, although the depth may also vary from the depth of the stiles and rails, to provide additional storage or for architectural design. The modular insert, as hereinafter described, may be useful for storing one or more objects.

In an embodiment of the disclosed technology, as shown in FIGS. 6-10, the modular insert 1 includes a frame 10 having a plurality of walls 110 forming a plurality of sides of the frame. Hingedly affixed on a first side 111 of the frame is a top panel 11, the top panel movable between an open and a closed position. In some embodiments the modular insert also has a base panel 12, wherein the walls of the frame are secured, by adhesive, staples or other means of affixation, about a perimeter of the interior surface of the base panel. When installed in a door having a void cavity, the back surface of this base panel becomes the exterior panel of the door, and may be made in the same material (e.g., timber species), or a different material, as the door. Other embodiments may not have a base panel, or the base panel may not become the exterior of the door, in which embodiments the door has one or more back panels, covering the back of the cavity. In these and other embodiments, the cavity may further have an internal frame 22 affixed to the stiles and rails (see, e.g., FIGS. 4 and 5), the internal frame having a reduced depth, wherein the reduction in depth is equal to the thickness of the top panel. In such configurations, as shown in FIG. 5 the top panel may be removed from the modular insert when it is being inset within the door, and movably affixed when the insert is fully inset with the door.

The top panel 11 of the embodiments shown in FIGS. 1, 2, and 6-11, is hingedly affixed to a first side of the frame by means of one or more hinges 112, each hinge comprising a pair of plates 113, 114, with the first plate 113 affixed to an interior surface of a frame wall, and the second plate 114 affixed to the top panel, the second plate swiveling about the first plate by means of the hinge pin or similar hinge mechanism. Hinges useful in the disclosed technology include butt, barrel, knuckle, gravity pivot and spring hinges. In the embodiment shown in FIGS. 6-10, a spring hinge is used to maintain the top panel secured in a closed position until opened by the user, and the second plate is secured to the top panel by means of a block 115, secured to an interior side of the top panel.

In other embodiments (not shown), the top panel is slidably engaged with the frame, wherein the frame and the top panel have corresponding rails to facilitate sliding engagement of the top panel relative to the frame. In some of these embodiments, the modular insert is removed from the cavity of the door prior to removing the top panel.

In some embodiments, such as those depicted in in FIGS. 6-11, the top panel is sized larger (about ¼' to 1") in length and width as compared to the dimensions of the frame. In these embodiments, when the modular insert has a base panel and the modular insert is intended to be inset into a void cavity of the door, the top and base panels are sized to be received within the door cavity. This embodiment of the disclosed technology works well when the door has an internal frame, as hereinabove described.

Figure 2:
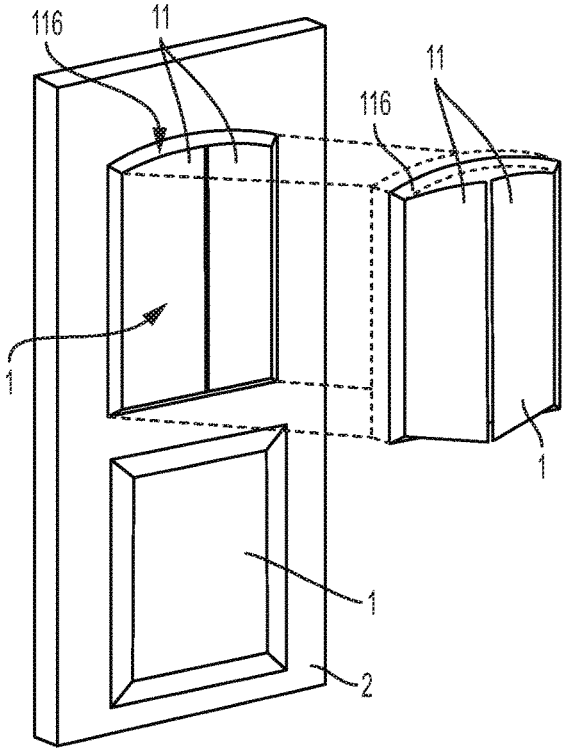
FIG. 2 is a perspective view of an embodiment of the door of the disclosed technology, with modular inserts installed and, with dashed lines, showing removal thereof.
Figure 3:
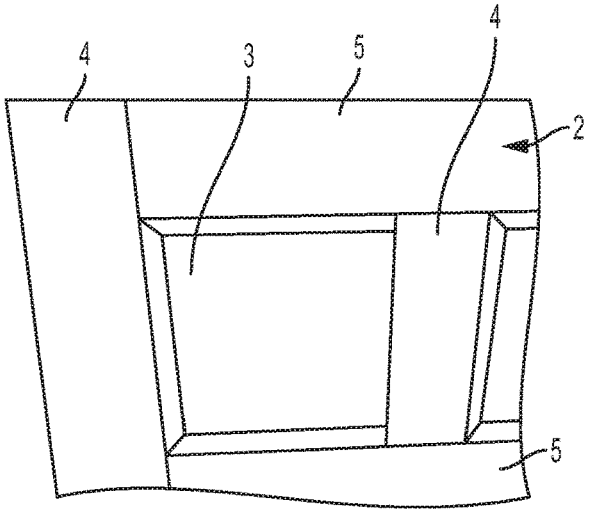
FIG. 3 is a perspective view of an embodiment of the cavity of the door of the disclosed technology.
Figure 12:
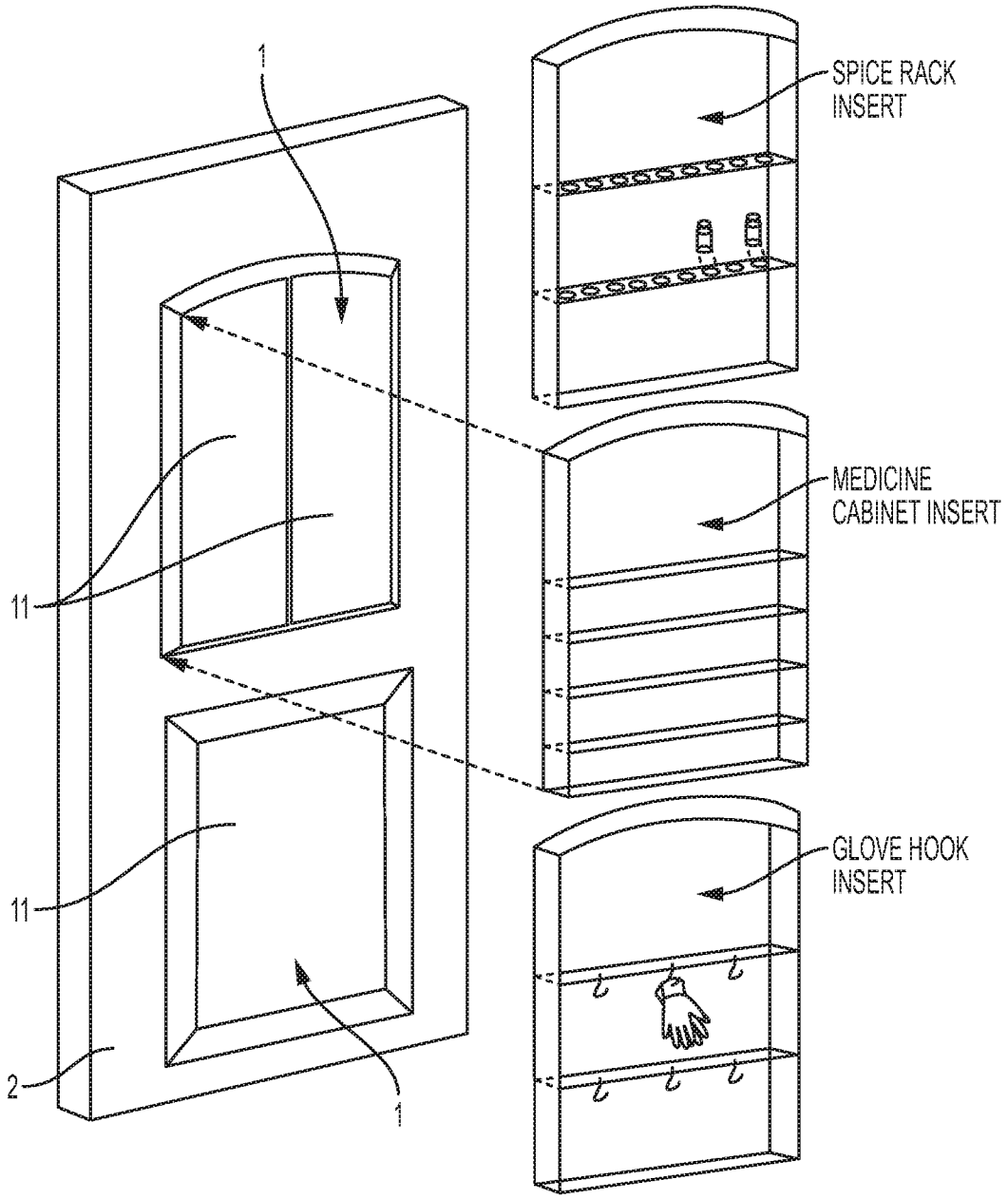
FIG. 12 is a perspective view of an embodiment of the door and the modular insert of the disclosed technology, with alternative support structures shown by dashed lines.
Figure 13:
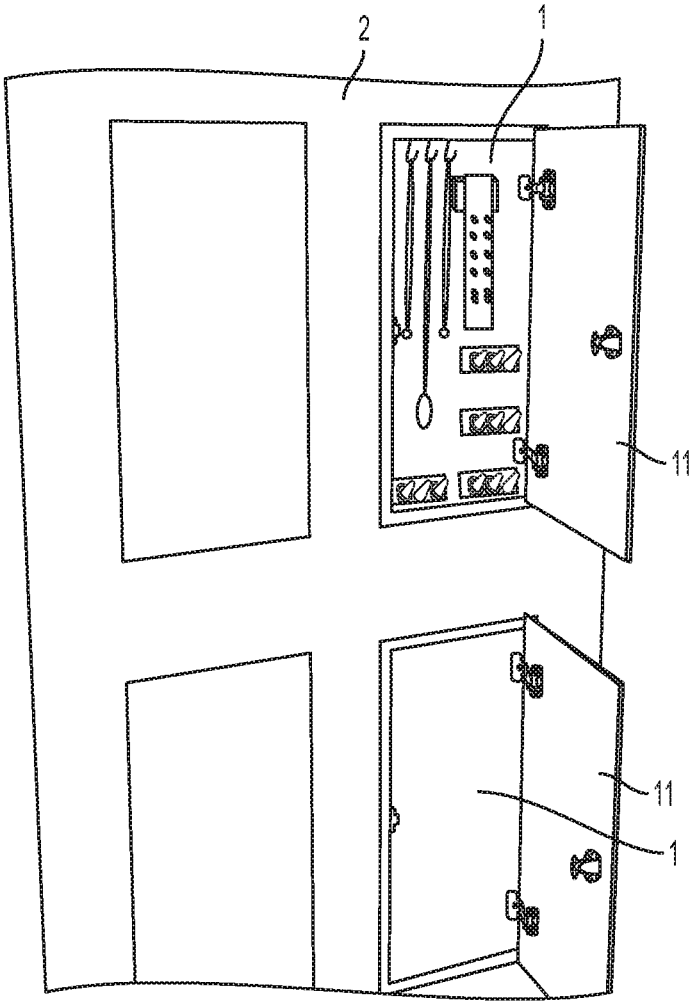
FIG. 13 is a front view of an embodiment of the door and modular inserts of the disclosed technology.
Figure 15:
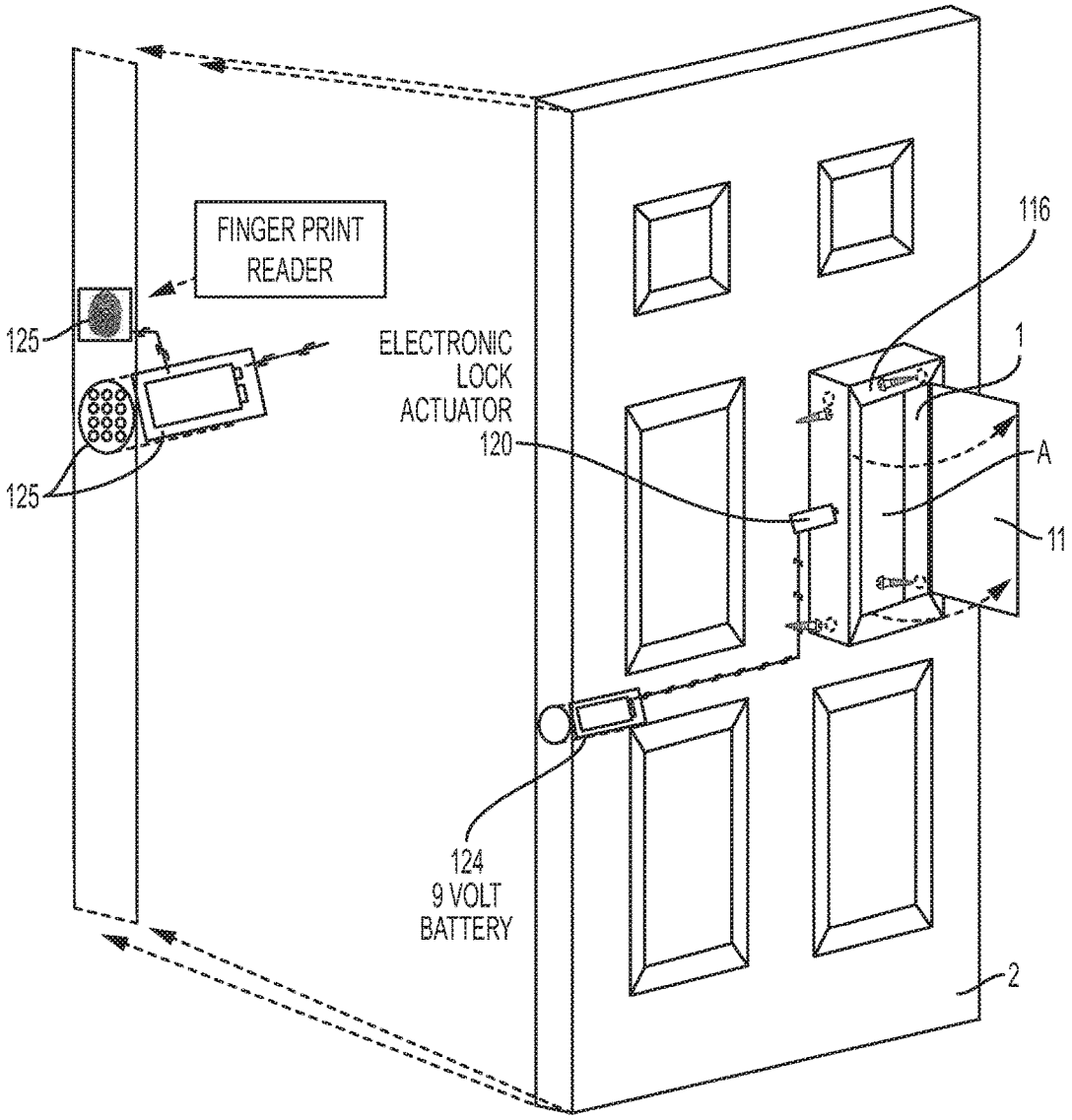
FIG. 15 is a perspective view of an embodiment of the door and the modular insert of the disclosed technology, having at the cutout a fingerprint reader and a keypad, controlling an actuator locking at least one of the modular inserts.

In another embodiment, shown in FIGS. 2 and 12, two top panels 11 are hingedly secured on opposing sides of the frame. Further, in these and other embodiments (including those described above), each of the frame walls may include a frame segment 116, extending from a front face of each wall into the vacuous area formed by the frame walls, as depicted in FIGS. 2 and 15. In these embodiments, the top panel(s) is(are) hingedly affixed to one of the frame segments (rather than directly to the interior of the wall, as with the prior embodiments).

Figure 7:
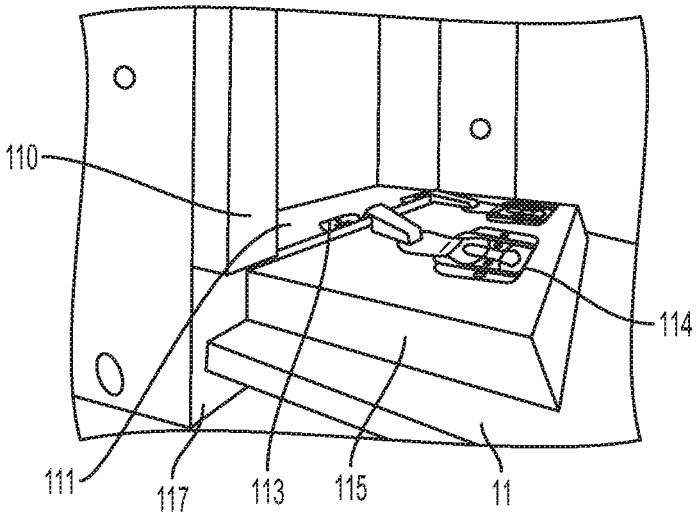
FIG. 7 is a perspective view of portions of embodiments of the top panel and the frame of the modular insert of FIG. 6.
Figure 8:
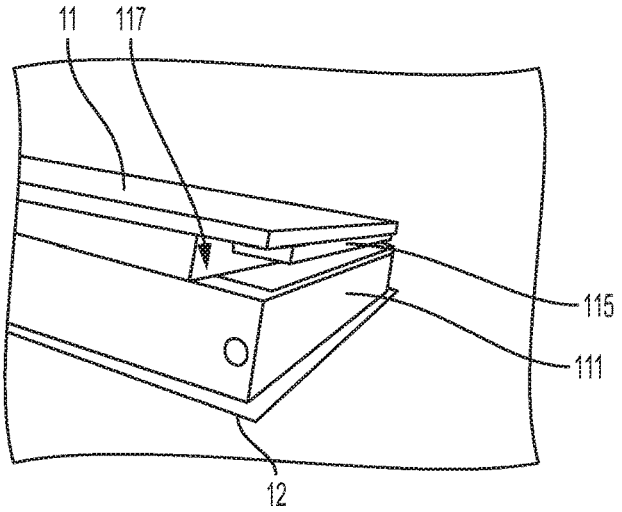
FIG. 8 is a perspective view of an embodiment of the modular insert of FIG. 6, with the top panel closed.
Figure 9:
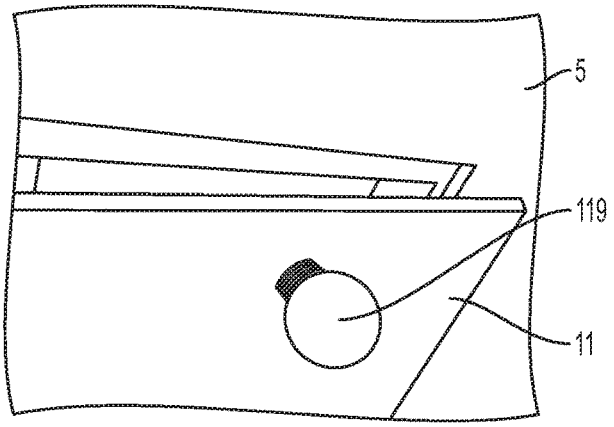
FIG. 9 is a front view of the embodiment of the modular insert of FIG. 6, with the magnet pull engaged with the magnet, facilitating opening of the top panel relative to the frame.
Figure 10:
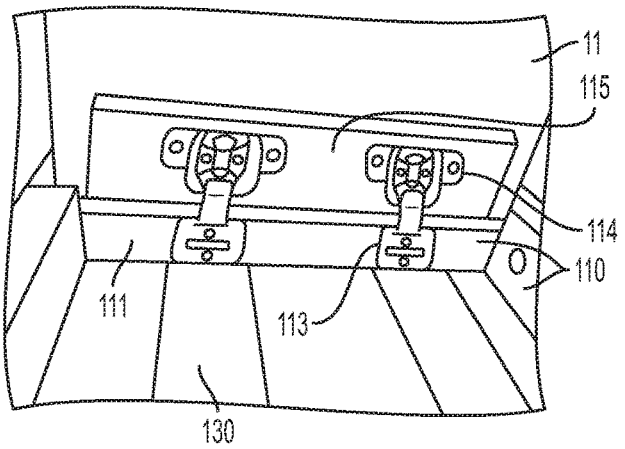
FIG. 10 is a perspective view of a portion of an embodiment of the modular insert of FIG. 6, with the top panel in the open position.

In the embodiments shown in FIGS. 7 and 8, the frame includes a recess 117 along the length of the first side 111 (the side that the top panel is hinged to) to facilitate opening of the top panel when installed in the frame.

To further facilitate opening the top panel, a pull may be secured to the exterior surface of the panel. However, because the pull may interfere with use of the door, in the embodiments shown a magnet 118 is secured on an interior surface of the top panel (see, e.g., FIG. 6). Suitable magnets have sufficient magnetic field to attract and removably secure a magnet knob 119 when removably positioned on an exterior surface of the top panel positioned near the position of the secured magnet (see, e.g., FIG. 9), thereby providing force against, for example, the force of the spring hinge, to allow the top panel to be opened (wherein the spring hinge otherwise secures the top panel in a closed position relative to the frame). Alternative embodiments hold the top panel closed relative to the frame, and facilitate the opening thereof, by means of a magnetic spring latch or magnetic catch.

Figure 11:
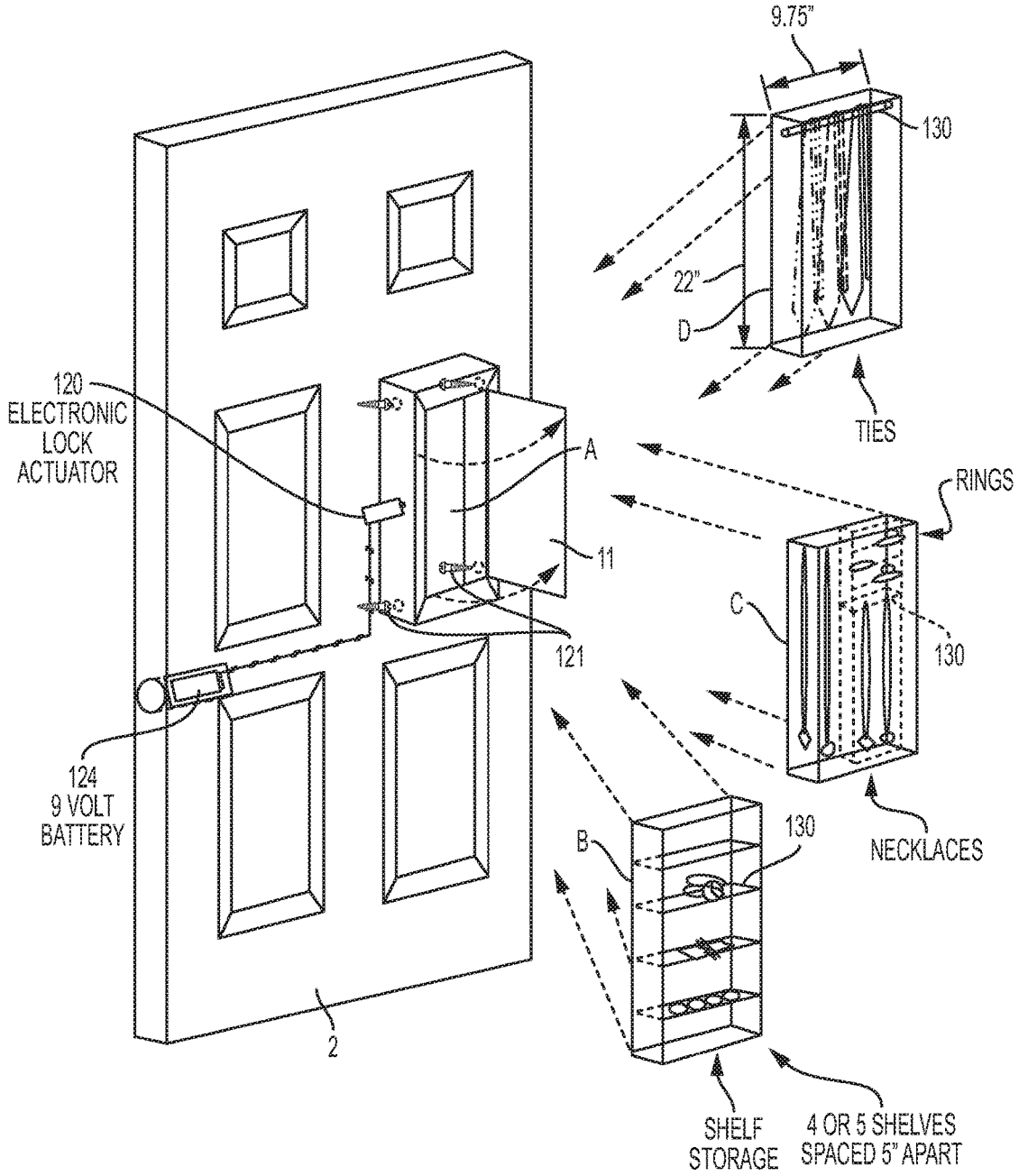
FIG. 11 is a perspective view of an embodiment of the door and the modular insert of the disclosed technology, with alternative support structures shown by dashed lines.
Figure 14:
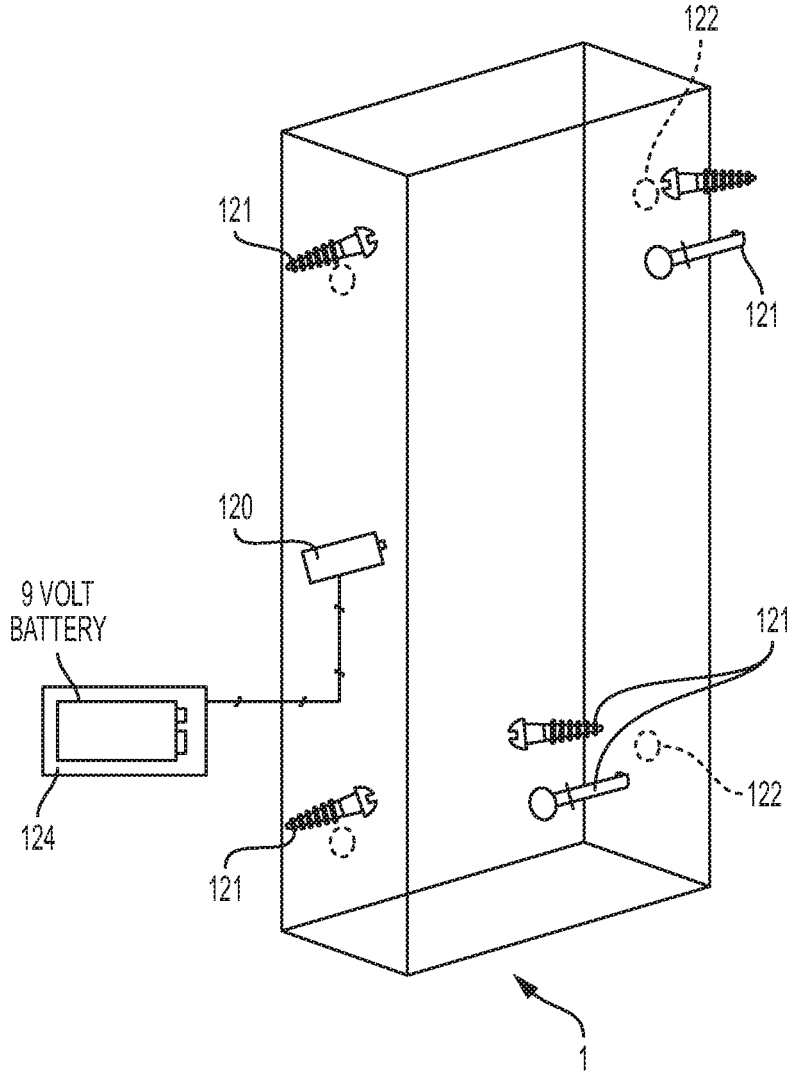
FIG. 14 is a perspective view of an embodiment of a modular insert of the disclosed technology, with various affixation means and a locking mechanism.
Figure 16:
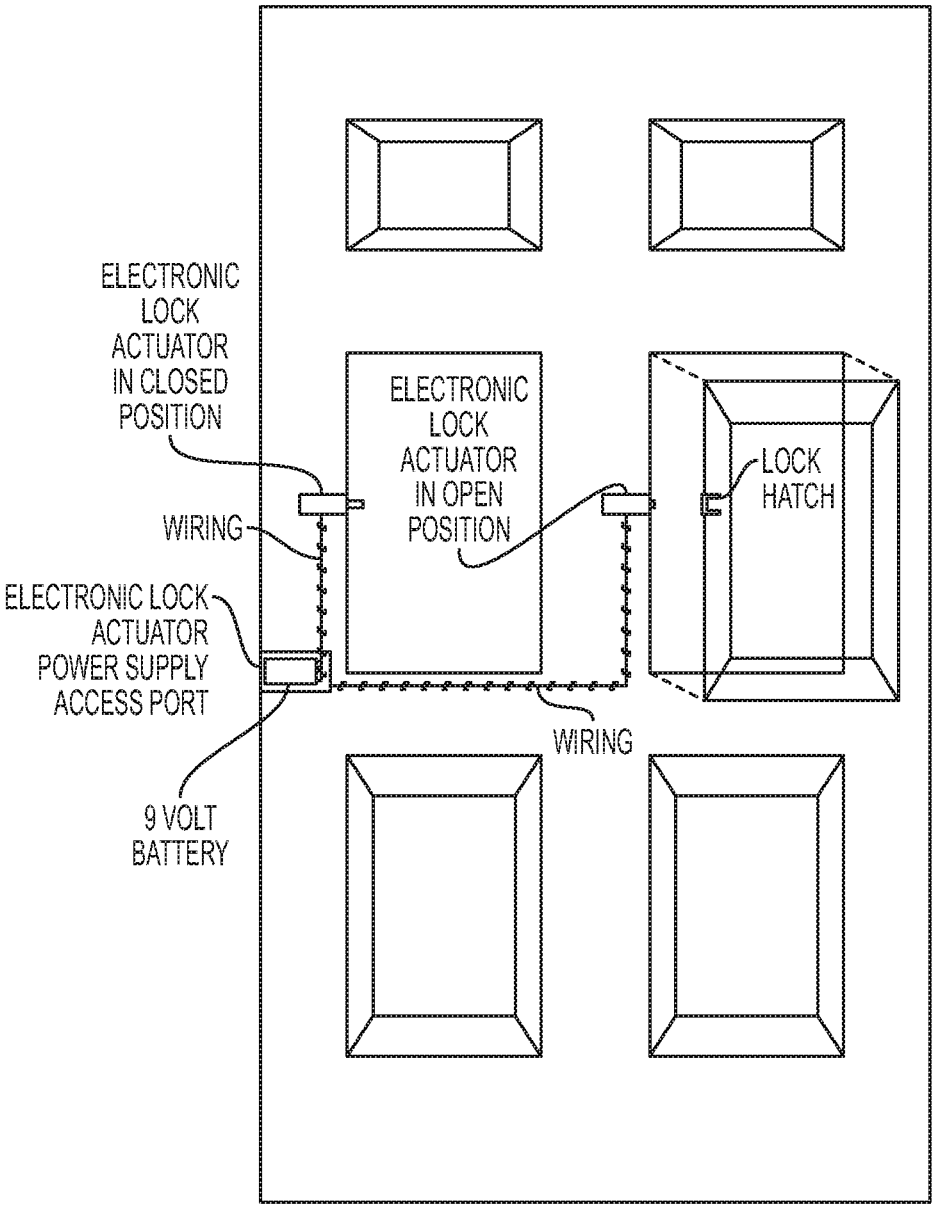
FIG. 16 is a perspective view of an embodiment of the door, having modular inserts which are locked and unlocked by means of an actuator.

In other embodiments, as shown for example in FIGS. 11, 14 and 15, an actuator 120 may be used to lock the top panel to the frame, such as by means of a power actuator affixed within a stile or rail, or within a modular insert, having a locking mechanism engaged with the top panel to lock the panel until the actuator releases the locking mechanism. In this embodiment, power may be provided to the actuator by means of a power supply, for example, a 9 volt battery 124 removably secured within the rails and stiles, as shown in FIG. 16. Wires associated with this configuration, between the power supply and the actuator, may be supplied through grooves provided within adjoining stiles or rails to accommodate the wire. The wiring can be run through the rail and stile in assembly of the door, with a connection point at the frame when the modular insert is inset in the door. For example, a hole may line up to the connection port in the door frame and the two connectors can be snapped together. In another embodiment, the base panel is attached to the door frame and the top panel is attached to the frame, the locking mechanism may be attached to the door frame and the catch, catch hook or catch plate will be attached to the panel door. The modular insert can be molded to fit around the locking mechanism.

In some embodiments, a battery holder may be installed into the outer edge of the door frame, with a removable cover plate that allows access to the battery holding area. The cover plate may be removable by way of two bolts or screws that pass through the cover plate and attach to the battery holder that is installed in the door frame. The cover plate may or may not have a spring or similar device attached to it on the inside to firmly hold the battery or battery holder in place. In this embodiment the battery may be a 9 volt snap connector with wire leads that are of sufficient length to be pulled out of the battery holder area and the re-inserted once the battery is snapped into the snap connector. Another embodiment may include a battery holder for multiple AA or A batteries that fit into the holder, wherein the holder is slid into the battery storage area of the door frame. In this embodiment the battery holder will have metal contact points that once slid into the storage area will come in contact with a connection point that is attached to the wires that go to the lock solenoids.

The position of the actuator between a locked and unlocked position may be controlled by means of a remote control, using known technologies. Alternatively, as shown in FIG. 15, the actuator may be controlled by means of known technologies including key pads, radio frequency identification using radio waves to identify people or objects carrying encoded microchips (RFID), gesture recognition, biometric recognition, and fingerprint recognition, and alternative combinations thereof.

As shown in the embodiments of FIGS. 11 and 14, the insert may be removably secured to the door, in the cavities, by fastening means 121 such as, for example, screws, bolts, quick release or push-pull pins and wing nuts, wherein the fastening means are received in apertures 122 on opposing sides of the frame. Although all of these fastening means allow for the removability of the insert, the use of wing nuts or quick release/push-pull pins may provide for tool-less, easy removal thereof. The apertures may comprise a threaded insert nut, or a nut with an aperture to receive a pin of a push-pull pin, or similar structure to allow the insert to be secured in the aperture by means of the fastener, but quickly released therefrom to remove the affixation means (and the modular insert from the door).

As hereinabove discussed, the modular insert is useful for storing one or more objects. Although the vacuous area 123 within the frame provides a good storage compartment for many objects, a support structure 130 may be affixed to the frame or base panel (if present), designed and configured to support one or more of the objects in the modular insert. For example, as shown in FIGS. 11 and 12, one or more shelves or storage compartments may be affixed to the interior surface of the base panel or the frame (or both) to support many types of objects. Apertures within such shelves may support multiple units of similar size, such as spice jars. These structures or the frame may support a plurality of hooks, as shown in FIGS. 6, and 11-13; alternatively, one or more hooks may be affixed to the frame or the base panel, useful to store jewelry and other hangable items. As depicted in FIG. 11, the support structure may also be configured as an adornment holder, affixed to the back wall or the frame, with apertures for example to support earrings or other similar items. Other support structures may include mirrors, shelves, and/or storage compartments so that the support structure can be used as a cosmetics station. To be useful to store ties or other similar items, the support structure may include a rod or a tie rack (see, e.g., FIG. 11). Other support structures may be used to store, for example, documents.

As shown in FIGS. 1-4, 11-13, and 15, the disclosed technology further regards a door 2 suitable for removably mounting one or more modular inserts 1, the door comprising a plurality of rails 5 and stiles 4, wherein the stiles and rails form one or more cavities 3. In some embodiments the door has a back panel; in other embodiments, the cavities create a void through the entire door.

Figure 4:
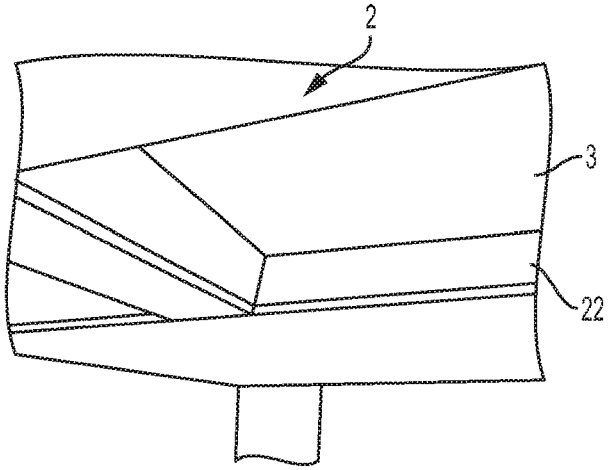
FIG. 4 is a perspective view of another embodiment of the cavity of the door of the disclosed technology.
Figure 5:
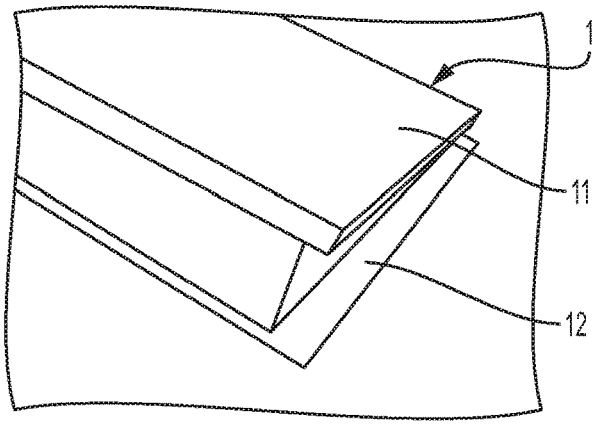
FIG. 5 is a partial view of embodiments of the door, and the modular insert partially inset within the door, of the disclosed technology, being received within a cavity of the door.
Figure 6:
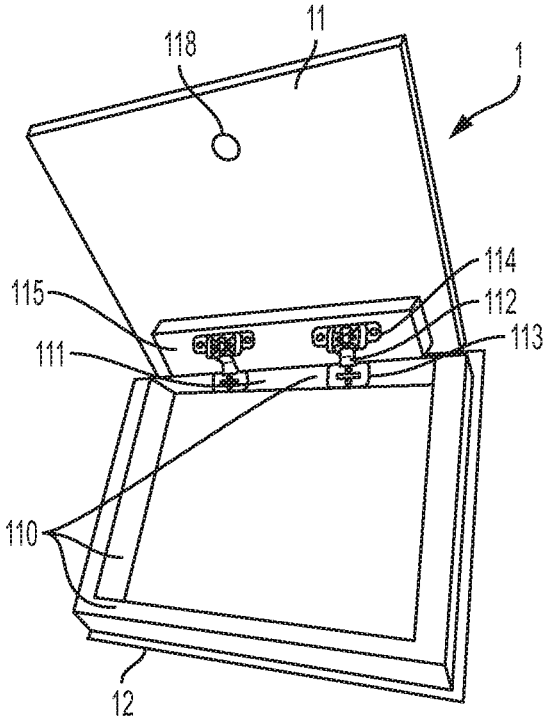
FIG. 6 is a perspective view of an embodiment of the modular insert of the disclosed technology.

In some embodiments, as shown in FIGS. 4 and 5, the cavities of the door have an internal frame affixed to the stiles and rails. This internal frame has a depth less than the depth of the stiles and rails, the reduction in depth being at least equal to a thickness of the top panel of the modular insert. By this configuration the top panel rests flush with the surface of the stiles and rails, when the modular insert is positioned within a door cavity.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A door useful for storing one or more objects, the door comprising:

a plurality of stiles and rails arranged to form a top, a bottom and opposing sides of the door, and to define one or more cavities, the cavities extending through the depth of the door creating a void; and one or more modular inserts sized and configured to be received within one of the cavities of the door, the modular inserts comprising:

a frame having a plurality of walls forming a plurality of sides of the frame, including a first side of the frame;

a top panel hingedly affixed to the first side of the frame; and a base panel, wherein the walls of the frame are secured to an interior surface of the base panel; and wherein at least two of the walls of the frame comprise a plurality of apertures to receive affixation means to removably secure the modular insert to the stiles forming the cavity of the door;

wherein the insert has a depth equal to the depth of the door; and wherein each cavity further comprises an internal frame affixed to the stiles and rails forming the cavity, the internal frame having a depth less than the depth of the stiles and rails, the reduction in depth being at least equal to a combined thickness of the top panel and the base panel.

2. The door of claim 1, wherein an exterior surface of the base panel is made from the same material as the door.

3. The door of claim 1, wherein the top panel is hingedly affixed to the first side of the frame by means of one or more hinges, each hinge comprising a pair of plates, wherein one of the plates of each hinge is secured to the first side of the frame, and the other plate of the hinge is affixed to the top panel by means of a block, secured to an interior side of the top panel, and wherein the walls forming the first side of the frame comprise a recess extending the length of the first side of the frame.

4. The door of claim 3, wherein the hinge is a spring loaded hinge.

5. The door of claim 1, further comprising a magnet affixed on the interior surface of the top panel, the magnet having a magnetic field to attract and removably secure a magnet knob when positioned on an exterior surface of the top panel.

6. The door of claim 1, wherein the top panel and the base panel of the modular insert each have a length and width greater than the length and width of the frame.

7. The door of claim 1, wherein the top panel comprises first and second panels, with the first panel hingedly secured on one side to the first frame wall, and the second panel is hingedly secured on one side to a second frame wall opposing the first frame wall.

8. The door of claim 1, further comprising securing means to removably secure the top panel in a closed position relative to the frame.

9. The door of claim 8, wherein the securing means is an actuator affixed to a wall of the frame, and wherein the actuator is electrically engaged with a power supply embedded within and accessible from the exterior of the door.

10. The door of claim 9, wherein the position of the actuator between a locked position and an unlocked position is controlled with a remote control.

11. The door of claim 8, wherein the securing means further comprises recognition means for recognizing a user, the recognition means being engaged with and determining the position of actuator, the recognition means selected from the group consisting of: radio frequency identification using radio waves to identify encoded microchips (RFID), gesture recognition, biometric recognition and fingerprint recognition.

12. The door of claim 1, wherein each of the frame walls comprise a frame segment, extending from a front face of each said frame wall into the vacuous area formed by the frame walls, and wherein the top panel is hingedly affixed to the frame segments of one of the frame walls.

13. The door of claim 1, further comprising a support structure affixed within the modular insert, the support structure designed and configured to support one or more objects in the modular insert.

14. The door of claim 13, wherein the support structure is selected from the group consisting of: shelves, hooks, adornment holders, individual storage compartment, rods, and tie racks.

15. A door useful for storing one or more objects, the door comprising, a plurality of stiles and rails arranged to form a top, a bottom and opposing sides of the door, and to define one or more cavities;

one or more back panels secured to one side of the door, the back panels covering an end of each of the cavities;

one or more modular inserts, each modular insert being sized and configured to be received within one of the cavities of the door, the modular inserts comprising:

a frame having a plurality of walls forming a plurality of sides of the frame, including a first side of the frame, wherein at least two of the walls of the frame comprise a plurality of apertures to receive affixation means to removably secure the modular insert to the stiles forming the cavity of the door; and a top panel hingedly affixed to the first side of the frame wherein each cavity further comprises an internal frame affixed to the stiles and rails forming the cavity, the internal frame having a depth less than the depth of the stiles and rails, the reduction in depth being at least equal to a combined thickness of the top panel and the back panel.

16. The door of claim 15, wherein the top panel is hingedly affixed to the first side of the frame by means of one or more hinges, each hinge comprising a pair of plates, wherein one of the plates of each hinge is secured to the first side of the frame, and the other plate of the hinge is affixed to the top panel by means of a block, secured to an interior side of the top panel, and wherein the walls forming the first side of the frame comprise a recess extending the length of the first side of the frame.

17. The door of claim 15, wherein the top panel has a length and width greater than the length and width of the frame.

18. The door of claim 15, further comprising a support structure affixed within the modular insert, the support structure designed and configured to support one or more objects in the modular insert, wherein the support structure is selected from the group consisting of: shelves, hooks, adornment holders, individual storage compartment, rods, and tie racks.

* * * * *